US008064804B2

(12) United States Patent
Oshima

(10) Patent No.: US 8,064,804 B2
(45) Date of Patent: Nov. 22, 2011

(54) CONDUCTIVE MEMBER, PROCESS CARTRIDGE USING THE CONDUCTIVE MEMBER, AND IMAGE FORMING DEVICE USING THE PROCESS CARTRIDGE

(75) Inventor: Tadayuki Oshima, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 385 days.

(21) Appl. No.: 12/324,550

(22) Filed: Nov. 26, 2008

(65) Prior Publication Data

US 2009/0142099 A1 Jun. 4, 2009

(30) Foreign Application Priority Data

Nov. 30, 2007 (JP) ..... 2007-309813

(51) Int. Cl.
*G03G 15/02* (2006.01)

(52) U.S. Cl. ..... 399/176; 399/168

(58) Field of Classification Search ..... 399/168, 399/176

See application file for complete search history.

(56) References Cited

U.S. PATENT DOCUMENTS

| | | | |
|---|---|---|---|
| 5,089,851 | A | 2/1992 | Tanaka et al. |
| 5,146,280 | A | 9/1992 | Kisu |
| 5,965,206 | A | 10/1999 | Hilti et al. |
| 2005/0100365 | A1 * | 5/2005 | Narita et al. |
| 2006/0269864 | A1 * | 11/2006 | Tarnawskyj et al. |
| 2007/0166076 | A1 * | 7/2007 | Oshima et al. ..... 399/168 |

FOREIGN PATENT DOCUMENTS

| | | | |
|---|---|---|---|
| JP | 63-149668 | | 6/1988 |
| JP | 1-211779 | | 8/1989 |
| JP | 1-267667 | | 10/1989 |
| JP | EP0338546 | A2 | 10/1989 |
| JP | 3-196072 | | 8/1991 |
| JP | 3-240076 | | 10/1991 |
| JP | 4-358175 | | 12/1992 |
| JP | 5-107871 | | 4/1993 |
| JP | 3196072 | | 6/2001 |
| JP | 2003-211542 | * | 7/2003 |
| JP | 2004-93948 | * | 3/2004 |
| JP | 2005-25021 | | 1/2005 |
| JP | 2005-77922 | * | 3/2005 |

OTHER PUBLICATIONS

English Abstract of JP 2005002154 to Ikuji.*
English Abstract of JP 2004317763 to Fujiwara.*
English Abstract of JP 2004224944 to Ishiguro.*
Mar. 4, 2009 European search report in connection with a counterpart European patent Application No. 08 25 3840.*

* cited by examiner

*Primary Examiner* — Ryan Walsh
(74) *Attorney, Agent, or Firm* — Cooper & Dunham LLP

(57) ABSTRACT

A conductive member includes, a conductive supporting body, an electric resistance-adjusting layer formed in the conductive supporting body, and a space holding member which is formed on each end of the electric resistance-adjusting layer and has a material different from a material of the electric resistance-adjusting layer, the space holding member constantly maintaining a space between an image carrier and the electric resistance-adjusting layer, and the electric resistance-adjusting layer including a resin composition having a thermoplastic resin (A) containing at least an ether group, a fibrous polymer (B), which do not melt in (A) and has an aromatic skeleton in a molecule, and an electrolyte salt (C).

15 Claims, 9 Drawing Sheets

CONDUCTIVE MEMBER, PROCESS CARTRIDGE USING THE CONDUCTIVE MEMBER, AND IMAGE FORMING DEVICE USING THE PROCESS CARTRIDGE

PRIORITY CLAIM

The present application is based on and claims priority from Japanese Patent Application No. 2007-309813, filed on Nov. 30, 2007, the disclosure of which is hereby incorporated by reference in its entirety.

BACKGROUND OF THE INVENTION

1. Technical Field

This disclosure relates to a conductive member, a process cartridge using the conductive member, and an image forming device using the process cartridge.

2. Description of the Related Art

In an electrophotographic process such as that carried out in a copier, a laser printer, or a facsimile, a conductive member is conventionally used as a charging member, which performs a charging process on an image carrier (photoconductor), and a transfer member, which conducts a transfer process on toners on the photoconductor.

FIG. 1 is a schematic view illustrating an image forming device.

Referring to FIG. 1, the image forming device includes an image carrier 11 (photoconductor) onto which an electrostatic latent image is formed, a charging member 12 (charging roller: conductive member), which conducts a charging process in a contact state or a close state, a laser light 13 or an exposure light such as a reflection light of an original, a toner carrier 14 (development roller), which adheres toners 15 onto the electrostatic latent image of the image carrier, a transfer member 16 (transfer roller), which transfers the toner image on the image carrier to a recording medium 17, and a cleaning member 18 (blade), which cleans the image carrier after the transfer process. In addition, reference number 19 denotes toners removed from the image carrier by the cleaning member, and reference number 20 denotes a developing unit and reference number 21 denotes a cleaning unit.

In FIG. 1, functional units generally required for another electrophotographic process are not required for the present invention; thus, those are omitted.

The image forming device forms an image in the following order.

1. The charging roller 12 charges a surface of the photoconductor 11 at a predetermined potential.

2. An exposure unit (not shown) irradiates an image light to the photoconductor 11, so as to form an electrostatic latent image corresponding to a predetermined image on the photoconductor.

3. The development roller 14 develops the electrostatic latent image by the toners 15, so as to form a toner image (visualize a toner image) on the photoconductor 11.

4. The transfer roller 16 transfers the toner image on the photoconductor 11 onto a recording medium 17.

5. The cleaning unit 21 cleans the toners remaining on the photoconductor 11 without being transferred.

6. The recording paper 17 to which the toner image is transferred by the transfer roller 16 is fed to a fixing unit (not shown) in the arrow B direction. The fixing unit heats and presses the toners, so as to fix the toners onto the recording paper 17.

By repeating the above processes from 1 to 6, a predetermined image is formed on the recording paper 17.

As a charging method using the charging roller 12, a contact charging method, which brings the charging roller 12 into contact with the photoconductor 11, is known (for example, refer to JP S63-149668A, JP H01-211779A, and JP H01-267667A). However, the contact charging method has the following problems.

1. Charging roller track: The component of the charging roller exudes from the charging roller, and then adheres onto the surface of the photoconductor. If this adhesion is developed, the track of the charging roller remains on the surface of the photoconductor.

2. Charging noise: When applying an alternating voltage to the charging roller, the charging roller which has contact with the photoconductor vibrates, causing charging noise.

3. The decrease in the charging performance by the adherence of toners on the photoconductor to the charging roller: Especially, by the above-described exuding, the toners easily adhere onto the charging roller.

4. The component of the charging roller easily adheres onto the photo conductor.

5. The permanent deformation of the charging roller which is caused when stopping the photoconductor for a long period of time.

In order to solve the above problems, a close charging method, which brings a charging roller closer to a photoconductor, is proposed (refer to, for example, JP S63-149668A, JP H01-211779A, JP H01-267667A, JP H03-240076A, JP H04-358175A, and JP H05-107871A).

In the close charging method, the distance of closest approach (hereinafter, referred to as a space) between the charging roller and the photoconductor is set to 50 μm to 300 μm. If a voltage is applied to the charging roller in a state in which the charging roller faces the photoconductor, the photoconductor is charged. In this close charging method, since the charging unit does not have contact with the photoconductor, the above-described problems 4, 5 of the contact charging method are solved. Due to the above-described problem 3, the amount of toners which adhere onto the charging roller is reduced, so the close charging method is advantageous.

A property required for the charging roller for use in the close charging method is different from that for the charging roller for use in the contact charging method.

A general charging roller for use in the contact charging method has a structure in which a cored bar is covered with an elastic body such as a vulcanized rubber. In this contact charging method, it is required that the charging roller uniformly have contact with the photoconductor, in order to uniformly charge the photoconductor.

In the close charging method, when the charging roller formed by such an elastic body is used, the following problems are caused.

1. It is necessary to dispose space holding members such as spacers in both sides of the charging roller, respectively, in order to form a space between the photoconductor and the charging roller. However, since the charging roller is made of the elastic body, it is difficult to uniformly maintain the space because of the deformation of the elastic body. As a result, displacement in the charged potential and an uneven image resulting from the displacement are caused.

2. The vulcanized rubber material which forms the elastic body deteriorates with age and easily deforms. Accordingly, the size of the space changes over time.

In order to solve the above problems, it is considered to use a thermoplastic resin which is a non-elastic body. Thereby, the space between the photoconductor and the charging roller can be uniformly maintained.

It is known that the charging mechanism to the surface of the photoconductor by the charging roller is a discharge mechanism according to Paschen's Law by micro-discharge between the charging roller and the photoconductor. It is necessary to control the resistance value of the thermoplastic resin in a semi-conductive range (about $10^6$ Ωcm-$10^9$ Ωcm), in order to maintain the photoconductor at a predetermined charged potential.

As a method of controlling this electric resistance value, a method of dispersing a conductive pigment such as a carbon black in a thermoplastic resin is known. However, if the thermoplastic resin (resistance adjusting layer) is set in a semi-conductive property range by using the conductive pigment, the variations in the resistance values are increased. As a result, a charging error is partially caused, which causes an image error.

On the other hand, as another method of controlling an electric resistance value, it is considered to use an ion-conductive material. Since the ion-conductive material disperses in a matrix resin on the molecular level, compared to the case when the conductive pigment is used, the variations in the resistance value are decreased. In this case, a partial charging error is not a problem relative to an image quality. However, a low-molecular-weight ion-conductive material such as an electrolyte salt has a property which easily bleeds out on the surface of the matrix resin. For this reason, the toners are firmly fixed onto the surface of the charging roller when bleeding out, resulting in an image error.

In order to avoid this bleeding out, it is considered to use a solid high-monocular form ion-conductive material such as a polyamide series elastomer or a polyolefin block polymer. In this case, the ion-conductive material disperses and fixes in the matrix resin, so that it hardly bleeds out on the surface. By only using the high-molecular form ion conductive material, the resistance-adjusting layer can not be controlled in the semi-conductive property range because the resistance value of the resistance-adjusting layer is high. For this reason, a method of applying a conductive property by adding an electrolyte salt is used. Such an electrolyte salt includes a perchlorate such as a sodium perchlorate or a lithium perchlorate, an organic phosphonium salt, or a fluorine-containing organic anion salt such as a trifluoromethanesulfonate lithium is used.

However, in the high-molecular form ion conductive material, since water from the air meditates in a conductive path, the water absorption property of the material itself is generally high, and the volume expansion degree (swelling property) by the water absorption is high. Accordingly, when the high-monocular form ion conductive material is used as the resistance-adjusting layer of the charging roller in the close charging method, the environmental variations of the space between the charging roller and the photoconductor are increased, and the charging performance is decreased, resulting in an image error. More particularly, since the charging roller expands in high-temperature and high-humidity environments, the size of the space between the charging roller and the photoconductor is decreased, and the charging roller may have contact with the photoconductor in an extreme case. In this case, since the discharge product on the photoconductor adheres onto the charging roller, the conductive property of that portion is lowered, resulting in an image error. On the other hand, since the size of the space is increased in low-temperature and low-humidity environment, the discharge from the charging roller to the photoconductor becomes uneven, resulting in an image error.

In order to reduce the swelling property of the charging roller, the blending quantity of the insulating thermoplastic resin is increased in the resistance-adjusting layer, or the functional group ratio, which contributes to the water absorption property in the high-molecular form ion-conductive material, is adjusted. Thereby, the swelling property can be reduced by the low water absorption of the material. In this case, the resistance is also increased, so that the conductive property required for the charging roller can not be obtained.

BRIEF SUMMARY

It was determined by the present inventors that the water absorption property can be reduced when blending a fibrous polymer which has an aromatic skeleton, an insulating property similar to the thermoplastic resin, and does not melt in the conductive material, without increasing the resistance as in a situation which increases the blending ratio of the thermoplastic resin. Further, the present inventors determined that the swelling property can be reduced while maintaining the conductive property of the charging roller and an image error is not caused by the environmental variations of the space between the charging roller and the photoconductor.

The present inventors also determined that, by blending graft copolymer with an affinity for both of the high-molecular ion-conductive material and the fibrous polymer, the dispersion state of the fibrous polymer is densifed, so that the water absorbability can reduced.

In an aspect of this disclosure, there is provided a conductive member which reduces the water absorption property without losing the conductive property of the conductive member, and has a small environmental variation of a space, a process cartridge having the conductive member, and an image forming device having the process cartridge.

In another aspect, there is provided a conductive member, including: a conductive supporting body; an electric resistance-adjusting layer formed in the conductive supporting body; and a space holding member which is formed on each end of the electric resistance-adjusting layer and has a material different from a material of the electric resistance-adjusting layer, the space holding member constantly maintaining a space between an image carrier and the electric resistance-adjusting layer, and the electric resistance adjusting layer including a resin composition having a thermoplastic resin (A) containing at least an ether group, a fibrous polymer (B), which does not melt in (A), and has an aromatic skeleton in a molecule, and an electrolyte salt (C).

Preferably, the fibrous polymer (B) is at least one or more type of fibrous polymer selected from a wholly aromatic polyamide fiber (aramid fiber), a wholly aromatic polyester fiber (polyarylate fiber), and a PBO (polyparaphenylenebenzobisoxazole).

Preferably, the electric resistance-adjusting layer includes a resin composition in which a thermoplastic resin (D) having a hardness higher than (A) is added to the resin composition.

Preferably, the electric resistance adjusting layer includes a resin composition in which a graft copolymer (E) with an affinity for (A) and (D) is added to the resin composition.

Preferably, the thermoplastic resin (A) containing the ether group is a compound containing at least a polyether ester amide and a polyether/polyolefin block polymer.

Preferably, the graft copolymer (E) is a graft copolymer having a polycarbonate resin in a main chain and an acrylonitrile-styrene-glycidylmethacrylate copolymer in a side chain.

Preferably, the resin composition is obtained by melting and kneading.

Preferably, the electrolyte salt (C) is at least one or more type of salt selected from a perchlorate, a fluorine-containing organic anion salt, and an organic phosphonium salt.

Preferably, the perchlorate is a salt selected from a lithium perchlorate and a sodium perchlorate.

Preferably, the fluorine-containing organic anion salt is a salt selected from a trifluoromethanesulfonate lithium, a bis (trifluoromethane)sulfonyl imide acid lithium, and a tris(trifluoromethane)sulfonyl methide acid lithium.

Preferably, a blending ratio of the fibrous polymer (B) is 0.01-30 pts.wt. relative to the entire resin composition.

Preferably, the conductive member charges the image carrier.

Another aspect of this disclosure relates to a process cartridge including the aforementioned conductive member.

Another aspect of this disclosure relates to an image forming device including the aforementioned process cartridge.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DETAILED DESCRIPTION OF THE PREFERRED EMBODIMENTS

Figure 1:
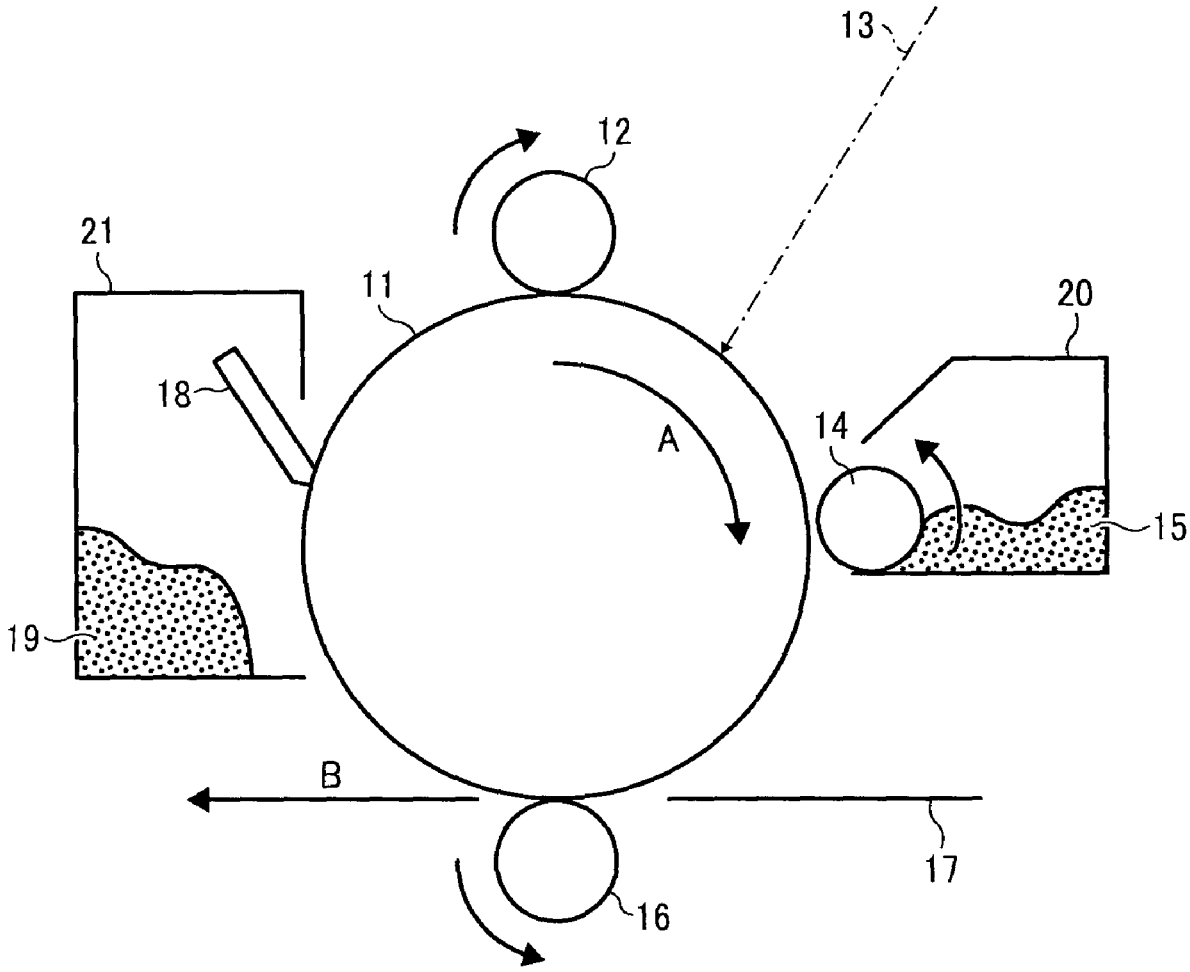
FIG. 1 is a schematic view illustrating an image forming device.

Hereinafter, an embodiment of a conductive member, a process cartridge having this conductive member and an image forming device using the process cartridge will be described with reference to the accompanying drawings.

An image forming device 1 includes four image carriers (photoconductor) 61 corresponding to four colors, yellow (Y), magenta (M), cyan (C), and black (K), each of which has a drum shape having a photosensitive layer on its surface, four charging units 100 each of which uniformly charges the surface of each image carrier 61, an exposure unit 70 which exposes each of the charged image carries 61 by means of a laser beam, so as to form an electrostatic latent image, four developing units 63 each of which houses each of four-color developers, yellow, magenta, cyan, and black, and forms a toner image corresponding to the electrostatic latent image of the image carrier 61, four primary transfer units 62 each of which transfers a toner image of the image carrier 61, a belt-shaped intermediate transfer body 50 to which the toner image of the image carrier 61 is transferred, a secondary transfer unit 51 which transfers the toner image of the intermediate transfer body 50 onto a recording medium (recording paper), a fixing unit 80 which fixes the toner image of the recording medium, and four cleaning units 64 each of which eliminates toners remaining on each of the image carriers 61 after the transferring.

The recording paper is fed to a resist roller 23 one by one via a transport path from one of a plurality of paper feeding cassettes 21 which house recording paper, by means of a transport roller. In this case, the recording paper is fed to a transfer position in synchronization with the toner image on the image carrier 61.

The exposure unit 70 of the image forming device 1 irradiates light L onto the image carrier 61 charged by the charging unit 100, so as to form an electrostatic latent image on the image carrier 61 having a photoconductive property. The light L can be a lamp such as a fluorescent light or a halogen lamp, or a laser light beam generated by a semiconductor element such as an LED or an LD. In this case, when the light L is irradiated in synchronization with a rotation speed of the image carrier 61 by signals from an image processor (not shown), an element of LD is used.

The developing unit 63 includes a developer carrier, and transfers toners stored in the developing unit 63 to an agitation section by a supplying roller. The agitation section mixes the toners with the developer containing carriers, and agitates them, and the developing unit 63 transfers them to the development area which faces the image carrier 61. The toners are charged into a positive polarity or a negative polarity. The toners are transferred to the electrostatic latent image of the image carrier 61, and the electrostatic latent image is developed. The developer may be magnetic or non-magnetic monocomponent developer, developer which uses the magnetic developer and non-magnetic monocomponent developer together, or developer which uses wet developer.

The primary transfer unit 62 forms an electric field having a polarity opposite to a polarity of the toners, so as to transfer the developed toner image of the image carrier 61 onto the intermediate transfer body 50 from the back side of the intermediate transfer body 50. The primary transfer unit 62 may be a transfer unit such as a corona transfer unit of coroton or scoroton, a transfer roller or a transfer brush.

After that, the toner image is transferred onto the recording medium by means of the secondary transfer unit 51 in synchronization with the recording medium fed from the paper feeding unit 22. In this case, the toner image can be directly transferred onto the recording medium without being transferred onto the intermediate transfer body 50.

The fixing unit 80 fixes the toner image onto the recording medium by heating and/or pressing the toner image onto the recording medium. In this case, the recording medium passes between a pair of pressure fixing rollers, and a pair of pressure fixing units fixes the toner image by heating and pressing the recording medium while melting the tie resin of the toners.

The fixing unit 80 having a roller shape may be a fixing unit having a belt shape, or a fixing unit which fixes a toner image by means of heat illumination with a halogen lamp or the like.

The cleaning unit 64 of the image carrier 61 removes the toners which remain on the image carrier 61 without being transferred, and enables next image formation. The cleaning unit 64 may be a blade made of a rubber such as a urethane or a fur brush made of fiber such as polyester.

Next, the operation of the image forming device 1 according to the embodiment of the present invention will be described.

In a reading section 30, an original is set on a platen of an original feeding section 36, or an original is set on the contact glass 31 by opening the original feeding section 36, and the original is held by closing the original feeding section 36. Then, when the original is set in the original feeding section 36, if a start switch (not shown) is pressed, a first moving stage 32 having a light source and a mirror and a second moving stage 33 having mirrors run after the original is fed to the contact glass 31, or if the original is set on the contact glass 31, the first and second moving stages 32, 33 immediately run.

The first moving stage 32 irradiates light from the light source, and reflects the light reflected from the original, so as to guide the reflected light to the second moving stage 33. Then, the reflected light is reflected by the mirror of the second moving stage 33, so as to be guided to a focusing lens 34. Then, the light guided to the focusing lens 34 is focused on a light-receiving surface of a CCD 35 which is a reading sensor, so as to read the image information on the original. The read image information is sent to a controller. The controller controls an LD or an LED (not shown) disposed in the exposure unit 70 of the image forming section 60 according to the image information received from the reading section 30, and irradiates a laser light L for writing toward the image carrier 61. By the irradiation of this laser light L, an electrostatic latent image is formed on the surface of the image carrier 61.

A paper feeding unit 20 takes out recording media by the paper feeding roller from the multi-stage paper feeding cassettes 21, feeds the taken out recording media by separating the media by a separation roller to a paper feeding path, and feeds the recording medium by the transfer roller to the paper feeding path of the image forming section 60. In addition to the paper feeding unit 20, a recording medium can be manually fed. The image forming device includes on the side face thereof a tray for manually feeding a recording medium, and a separation roller which separates the recording media on the tray one by one toward the paper feeding path. The resist roller 23 discharges one recording medium placed in each of the paper feeding cassettes 21, and sends the recording medium to a secondary transfer section located between the intermediate transfer body 50 and the secondary transfer unit 51. In the image forming section 60, a latent image is formed on the image carrier 61 by conducting the above-described laser writing and development process after receiving the image information from the reading section 30.

The developer in the developing unit 63 is taken up by a magnetic property (not shown) to be retained, and forms a magnetic brush on the developer carrier. Moreover, the developer transfers onto the image carrier 61 by the development bias voltage applied to the developer carrier, and visualizes the electrostatic latent image on the image carrier 61, so as to form the toner image. The development bias voltage is a voltage in which an alternating voltage is superimposed with a direct voltage. Next, one of the paper feeding rollers of the paper feeding unit 20 is operated so as to feed a recording medium having a size corresponding to a size of the toner image. Associated with this operation, one of the supporting rollers rotates by a driving motor, and other two other supporting rollers rotate, and then the intermediate transfer body 50 rotates. At the same time, monochromatic images of black, yellow, magenta, cyan are formed on the image carriers 61, respectively, by rotating the image carriers 61 in the image forming sections at the same time, respectively. Together with the feeding of the intermediate transfer body 50, the monochromatic images are sequentially transferred onto the intermediate transfer body 50, so as to form a composite image on the intermediate transfer body 50.

On the other hand, one of the paper feeding rollers of the paper feeding unit 20 is selected and rotates so as to take out recording media from one of the paper feeding cassettes 21. The recording media are separated one by one by the separation roller such that each recording medium is guided to the paper feeding path. Then, the recording medium is led to the paper feeding path in the image forming section 60 of the image forming device 1 by a feeding roller, and the recording medium hits the resist roller 23 and stops. The resist roller 23 rotates so as to be timed with the composite image on the intermediate transfer body 50, and the recording medium is sent to the secondary transfer section which is a contact section of the intermediate transfer body 50 and the secondary transfer unit 51. The toner image formed in the secondary transfer section is recorded on the recording medium by secondary transferring the toner image with effects such as secondary transfer bias and contact pressure. In this case, it is preferable for the secondary transfer bias to be direct current. The recording medium after the image is transferred is sent to the fixing unit 80 by the transferring belt of the secondary transfer unit, and is discharged onto the discharge tray 40 by the discharge roller 41 after fixing the toner image by the pressure of the pressurizing roller and applying heat in the fixing unit 80.

Hereinafter, a will be described when the conductive member according to the embodiment of the present invention is used as the charging member in the charging unit 100.

Figure 4:
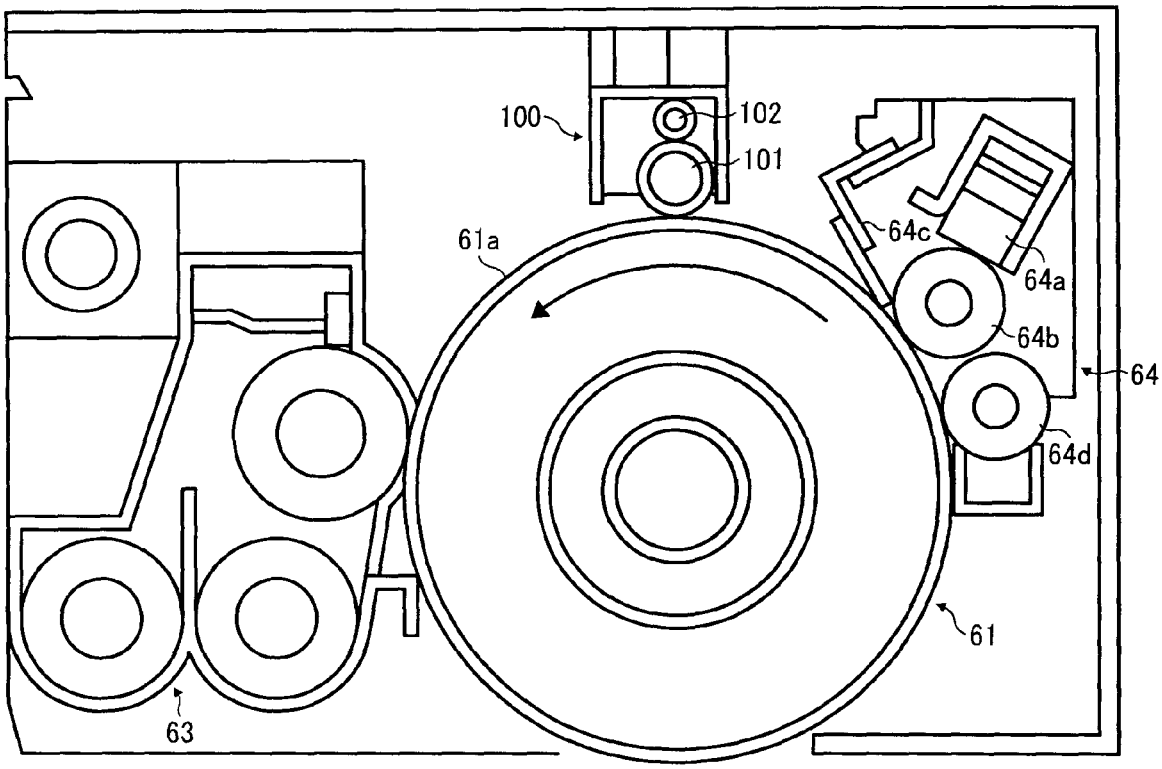
FIG. 4 is a schematic view illustrating a structure of the charging unit and the process cartridge according to the embodiment of the present invention.

FIG. 4 is a schematic view illustrating the structures of the charging unit 100 and the process cartridge according to the embodiment of the present invention. The process cartridge includes the image carrier 61, the charging unit 100, and the cleaning unit 64. As illustrated in FIG. 4, the process cartridge may include the developing unit 63. The process cartridge can be attached to the image forming device 1 and removed from the image forming device 1.

Figure 3:
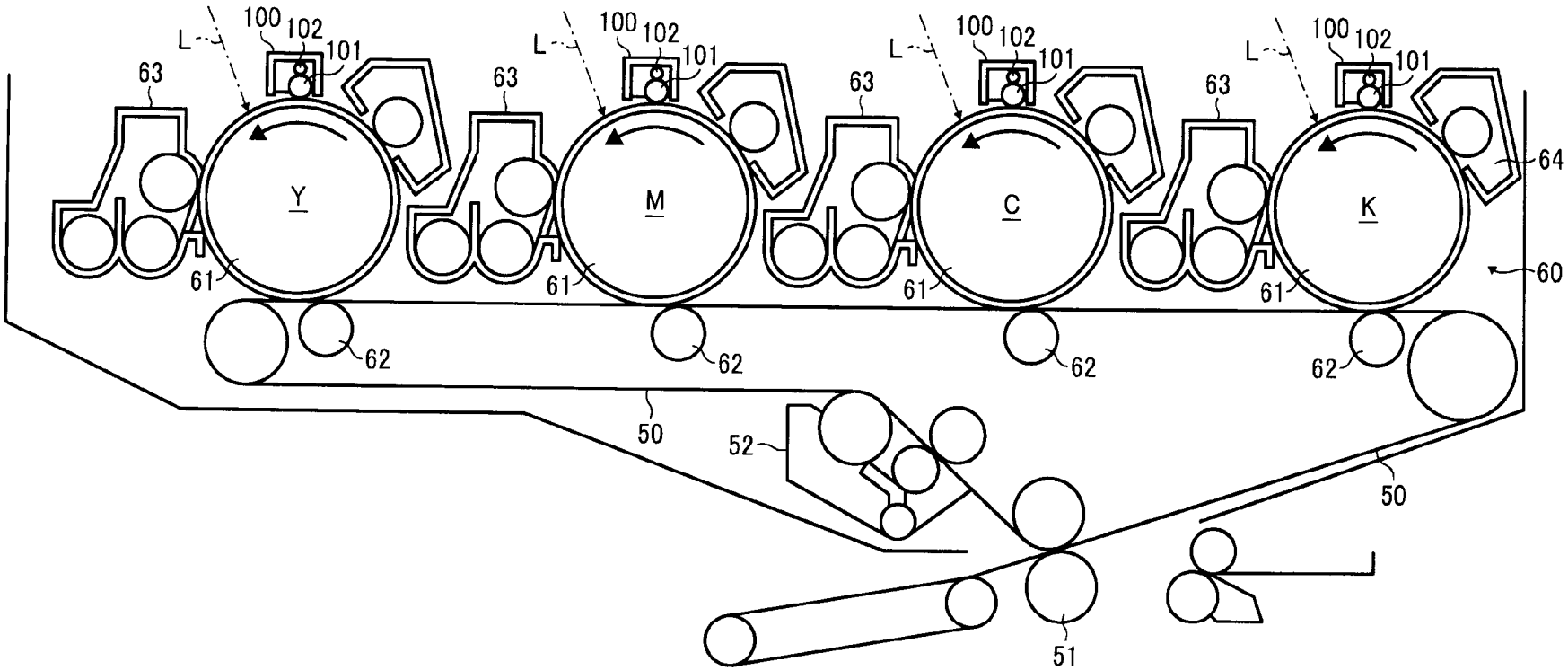
FIG. 3 is a schematic view illustrating an image forming section of the image forming device illustrated in FIG. 2.

Referring to FIG. 3, the surface of the image carrier 61 is uniformly charged by the charging member (conductive member) 101 disposed in an image forming area of the surface of the image carrier 61 without having contact with the surface of the image carrier 61. An electrostatic latent image is formed on the surface of the image carrier 61 by the light L. This electrostatic latent image is visualized by developing, and the toner image is transferred onto the recording medium. The toners remaining on the image carrier 61 without being transferred onto the recording medium are collected by an auxiliary cleaning member **64*d* (refer to FIG. 4). After that, in order to prevent the toners and the materials of the toners from adhering onto the surface of the image carrier 61, solid lubricant 64*a* is uniformly applied onto the image carrier 61 by means of an applying member 64*b* so as to form a lubricant layer. After that, the toners which are not collected by the auxiliary cleaning member 64*d* are collected by a cleaning member 64*c***, and are transported to a discharge toner collecting section.

The auxiliary cleaning member **64*d* has a roller shape or a brush shape. As the solid lubricant, a fatty acid metallic salt such as a zinc stearate, a polytetrafluoroethylene, or the like, which can apply a non-adherence property while reducing a friction coefficient on the image carrier 61**, can be used. As the cleaning member, a blade made of a rubber such as a silicone or a urethane, a fur brush made of a fabric such as polyester, or the like can be used.

The charging unit 100 includes a cleaning member 102 for eliminating the contamination of the charging member 101. The shape of the cleaning member 102 may be a roller shape or a pad shape; however, in this embodiment, the shape of the cleaning blade 102 is a roller shape. The cleaning member 102 fits to shaft supporters 107 provided in a housing (not shown) of the charging unit 100, and is rotatably supported. This cleaning member 102 has contact with the charging member 101 so as to clean the outer circumferential face of the charging member 101. If foreign substances such as toners, powdered paper, and breakage of a member adhere onto the surface of the charging member 101, the electric field concentrates on the foreign substance portion, so that abnormal discharge, which causes the discharge by priority, is caused. On the other hand, if electrically insulating-foreign substances adhere in a wide area, the discharge is not caused in that area, so that a charged spot is generated on the image carrier 61. For this reason, it is preferable to dispose the cleaning member 102 which cleans the surface of the charging member 101 in the charging unit 100. A brush made of a fabric such as polyester, or a porous body (sponge) such as a melamine resin can be used as the cleaning blade 102. The cleaning member 102 can rotate associated with the rotation of the charging member 101, or can perform an intermittent operation which repeats contact and separation.

The charging unit 100 includes a power source which applies a voltage to the charging member 101. It is possible to use only a direct voltage as the voltage; however, it is preferable to use a voltage in which a direct voltage is superimposed with an alternating voltage. When the layer structure of the charging member 101 has an uneven portion, the surface potential of the image carrier 61 may become uneven by applying only a direct voltage. However, if the superimposed voltage is applied, the surface potential of the charging member 101 becomes even, and the image carrier can be uniformly charged because of the stabilized discharge. It is preferable for the alternating voltage in the superimposed voltage to have a voltage between peaks which is twice that of a voltage at the start of charging of the image carrier 61. The voltage at the start of charging is an absolute value of a voltage when the image carrier is started to be charged when applying only the direct current to the charging member 101. Thereby, reverse discharge from the image carrier 61 to the charging member 101 is caused, and the image carrier 61 can be uniformly charged with a further stabilized state by the reverse discharge. It is also preferable for a frequency of the alternating voltage to be 7 times or more of the peripheral velocity (process speed) of the image carrier 61. By setting the frequency 7 times or more, a moiré image becomes unrecognized.

In the embodiment of the present invention, the auxiliary cleaning member is a brush roller, and the solid lubricant is a zinc stearate which is formed into a block shape. By pressurizing the brush roller which is the applying member by means of a pressurizing member such as a spring, the solid lubricant scraped from the solid lubricant block is applied to the image carrier 61 by an application roller. The cleaning member has a counter method using a urethane blade. This cleaning member of the charging member can preferably clean the stain on the surface of the charging member by the rotation associated with the rotation of the charging roller while using a sponge roller made of a melamine resin.

Figure 5:
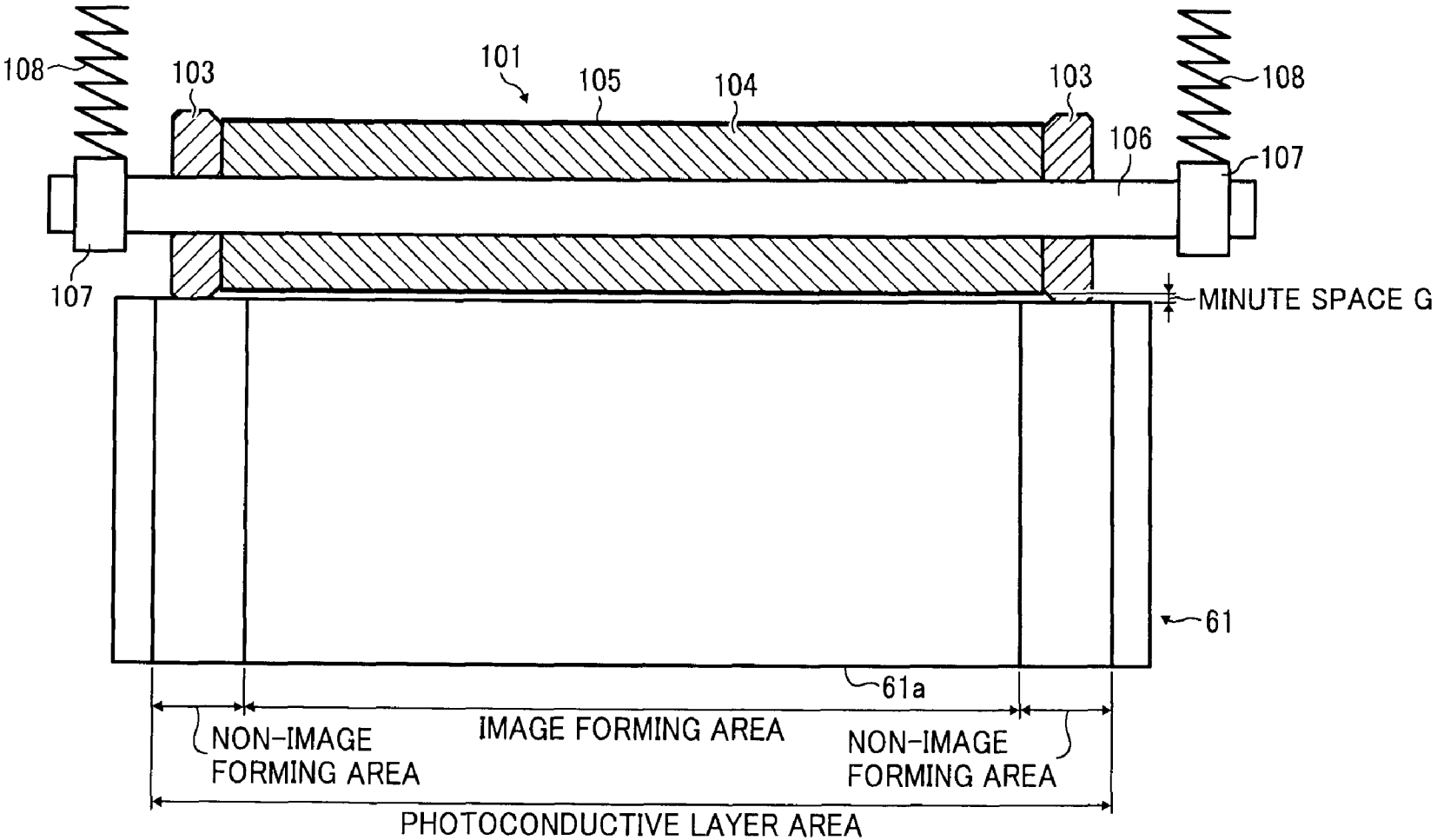
FIG. 5 is a schematic view illustrating a positional relationship among the charging member as the conductive member, a photosensitive layer area of an image carrier, an image forming area, and a non-image forming area according to the embodiment of the present invention.

FIG. 5 is a schematic view illustrating the charging member 101 of the conductive member and a positional relationship of the photosensitive area, the image forming area and the non-image forming area of the image carrier 61.

The charging unit 100 includes the charging member 101 which is disposed to face the image carrier 61, the cleaning member 102 which cleans the charging member 101, the power source (not shown) which applies a voltage to the charging member 101, and a pressure spring (not shown) which pressurizes the charging member 101 so as to have contact with the image carrier 61.

As illustrated in FIGS. 4, 5, the charging member 101 is disposed to face the image carrier 61 via a minute space G between the charging member 101 and the image carrier 61. The space G between the charging member 101 and the image carrier 61 is formed by bringing space holding members 103, which are disposed coaxially with the charging member 101 in both end portions of the charging member 101, into contact with the non-image forming areas of the charging member 101. By the contact of the space holding members 103 to the photosensitive area, variations in the space can be prevented even if the application thickness of the photosensitive layer is varied.

As illustrated in FIG. 5, the charging member 101 includes a conductive supporting body (core shaft) 106, an electric resistance-adjusting layer 104 formed on the conductive supporting body 106, and the space holding members 103 disposed in the both end portions of the electric resistance-adjusting layer 104, respectively. The electric resistance-adjusting layer 104 has on the surface thereof a surface layer 105 which prevents the toners and the toner additive agent from adhering onto the electric resistance adjusting layer 104.

The shape of the charging member 101 is not especially limited. It can be fastened in a belt shape, a blade (plate) shape or a semicircle shape. The charging member 101 can be a cylindrical shape having both ends rotatably supported by gears or shaft supports, respectively. As described, the charging member 101 is formed by a curved surface which gradually separates from the closest position to the image carrier 61 to the upstream and downstream directions of the moving direction of the image carrier 61, so that the image carrier 61 can be uniformly charged. If the charging member 101 facing the image carrier 61 has a sharp portion, the electrical potential of the sharp portion is increased. For this reason, the discharge starts from that portion, so that it becomes difficult to uniformly charge the image carrier 61. Accordingly, it is preferable for the charging member 101 to have a cylindrical shape having a curved surface. Thereby, the image carrier 61 can be uniformly charged.

The discharging surface of the charging member 101 is deteriorated by a strong load. The discharge always generates at the same portion, so the deterioration is developed, resulting in damage. If the charging member 101 includes a cylindrical shape and its entire surface is used as the discharge face, the development of the deterioration can be prevented by appropriately rotating the charging member 101, and the charging member 101 can be used for a long period of time.

The space G between the charging member 101 and the image carrier 61 is set to 100 μm or less, especially, about 5-70 μm by adjusting the diameter of the space holding member 103. The formation of an abnormal image can be thereby controlled in the operation of the charging device 100. When the space G is 100 μm or more, the distance in which the discharge reaches the image carrier 61 is increased, and the discharge start voltage of Paschen's Law is increased. If the discharge space is increased, a lot of discharge products by the discharge are required for charging the image carrier 61. These discharge products remain in the discharge space after forming an image, and adhere onto the image carrier 61, causing the development of the time degradation of the image carrier 61. When the space G is small, the distance in which the discharge reaches the image carrier 61 is short, and the image carrier 61 can be charged with small discharge energy. However, the discharge space is decreased, and the flow of air is deteriorated. For this reason, a lot of discharge products formed in the discharge space remain in the discharge space after forming an image similar to the situation of the large space G, and adhere onto the image carrier 61, resulting in the development of the time degradation of the image carrier 61. Therefore, it is preferable to reduce the generation of the discharge product by decreasing the discharge energy and to form a space having a size in which air does not stay in the discharge space. Accordingly, it is preferable for the space G to be 100 μm or less, especially, 5-70 μm. By this structure, the generation of the streamer discharge is prevented, and the generation of the discharge products can be decreased. Therefore, the amount of the discharge products which accumulate in the image carrier 61 can be reduced, and the generation of the image spot and image deletion can be prevented.

In this case, the toners remaining on the image carrier 61 after developing are cleaned by the cleaning unit 64 which is disposed to face the image carrier 61. However, it is difficult to completely remove the toners. Accordingly, the slight amount of toners pass through the cleaning unit 64, and are transported to the charging unit 100. In this case, if the particle diameter of the toner is larger than the space G, the toners are heated by the friction against the image carrier 61 and the charging member 101, and may bond to the charging member 101. In this case, the toner bonded part gets closer to the image carrier 61, so the abnormal discharge in which the discharge occurs by priority is caused. Therefore, it is preferable for the space G to be larger than the maximum particle diameter of the toner for use in the image forming device 1.

As illustrated in FIGS. 4, 5, the charging member 101 fits to the shaft supporters disposed in the side plate of the housing (not shown) of the charging unit 100. However, even if the charging member 101 fits to the shaft supporters 107, the size of the space G changes by the vibration when rotating, the eccentricity of the charging member 101, and the asperity of the surface, and the size of the space G may be deviated from the appropriate range, resulting in the development of the deterioration of the image carrier 61. For this reason, the charging member 101 is pressed in the direction of the surface of the image carrier 61 by compression springs 108 disposed in the shaft receivers 107, respectively, each of which does not drive with the shaft receiver 107 and is made of resin having a low friction coefficient. Therefore, even if the mechanical vibration and the displacement of the cored bar are caused, the space G having a predetermined size can be formed. The load which presses the charging member 101 by the compression spring 108 is set to 4-25N, preferably, 6-15N. In this case, the load means all load which is applied to the image carrier 61 via the space holding members 103.

This load can be adjusted by the strength of the compression springs 108 disposed in both ends of the charging member 101, the own weight of the charging member 101 and the cleaning member 102 and the like. If the load is small, the fluctuation of the charging member 101 in the rotation and the leaping of the charging member 101 by the impact of the driving gear can not be controlled. On the other hand, if the load is large, the friction between the charging member 101 and the shaft supporter 107 is increased. The temporal wear volume is thereby increased, so that the fluctuation of the charging member 101 is developed. Accordingly, it is preferable for the load to be set to 4-25N, more preferably to 6-15N, so as to set the size of the space G to the appropriate range. Therefore, the generation of the discharge product is decreased, the number of discharge products to be accumulated in the image carrier 61 is reduced, the operating life of the image carrier 61 is increased, and the generation of image spot and image deletion can be prevented.

The diameter of a part of the space holding member 103 is set to be larger than the diameter of the electric resistance adjusting layer 104. The space G can be formed by simultaneously processing the electric resistance adjusting layer 104 and the space holding members 103 with an elimination process such as a cutting process or a grinding process. By simultaneously processing the space holding members 103 and the electric resistance adjusting layer 104, the space G can be formed with high accuracy.

If the diameter of the space holding member 103 is set to be larger than the diameter of the electric resistance adjusting layer 104 in the side opposite to the electric resistance adjusting layer 104, and is gradually reduced as the space holding member 103 approaches the electric resistance adjusting layer 104, the contact width between the space holding member 103 and the image carrier 61 is reduced, and the space G between the conductive member 101 and the image carrier 61 can be maintained with high accuracy. Since the end portion of the space holding member 103 on the electric resistance adjusting layer 104 side does not have contact with the image carrier 61, the generation of leak current between the electric resistance adjusting layer 104 and the image carrier 61 via this end portion can be prevented. If the diameter of the space holding member 103 is set to be larger than the diameter of the electric resistance adjusting layer 104 on the side opposite to the electric resistance adjusting layer 104, and is processed to be reduced as the space holding member 103 approaches the electric resistance-adjusting layer 104, the adjacent portion of the space holding member 103 and the electric resistance-adjusting layer 104 can be a clearance of a cutting blade when conducting the elimination process. The shape of the clearance can be any shape as long as the end portion of the space holding member 103 on the electric resistance-adjusting layer 104 side does not have contact with the image carrier 61.

It is difficult to apply masking when coating the surface layer 105 to the adjacent portion of the electric resistance-adjusting layer 104 and the space holding member 103 because of the variations. Therefore, when forming the adjacent portion of the electric resistance-adjusting layer 104 and the space holding member 103, if the surface layer 105 is formed to the adjacent part of the electric resistance-adjusting layer 104 and the space holding member 103, the surface layer 105 can be effectively formed on the electric resistance-adjusting layer 104.

A necessary feature of the space holding member 103 is to stably maintain the space G between the photoconductor and the space holding member 103 for a long period of time without depending on environment. Accordingly, it is preferable for a material of the space holding member 103 to have a small hygroscopic property and a small abrasion-resistance property. It is also important that the toners and toner additive agent do not adhere onto the space holding member 103, and the space holding member 103 does not wear the photoconductor. The material of the space holding member 103 is appropriately selected according to the various conditions.

In particular, the material of the space holding member 103 includes a general-purpose resin such as a polyethylene (PE), a polypropylene (PP), a polyacetal (POM), a polymethacrylmethacrylate (PMMA), or a polystyrene (PS) and a polystyrene copolymer (AS, ABS), a polycarbonate (PC), a urethane, and a fluorine (PTFE). In order to effectively fasten the space holding member 103 to the electric resistance-adjusting layer 104, an adhesive agent can be used. It is also preferable for the space holding member 103 to use an insulating material having a volume resistivity of $10^{13}$ Ωcm or more. As described above, the space holding member 103 requires an insulating property so as to prevent the generation of the leak current between the space holding member 103 and the image carrier 61 as described above. The space holding member is molded by a molding process.

The electric resistance-adjusting layer 104 is made of a resin material containing a thermoplastic resin (A) containing at least an ether group in the molecule, a fibrous polymer (B) which does not melt in (A) and has an aromatic skeleton in the molecule, and an electrolyte salt (C), in order to obtain A conductive mechanism by an ion-conductive property. The electric resistance-adjusting layer 104 requires an ion-conductive property because when an electronically conductive agent such as carbon black is used, the discharge is generated to the image carrier via the electrically conductive agent, and minute discharge unevenness resulting from the dispersion condition of the electrically conductive agent is easily caused, which disturbs a high quality image. This phenomenon is especially remarkable when applying a high voltage. The ionic conductive material includes a low-molecular-weight salt such as an alkali metal salt or an ammonium salt. However, such a salt polarizes by power distribution and easily bleeds out.

Accordingly, as a high-molecular form ionic conductive material, a thermoplastic resin containing an ether group is used. By containing an ether group in the molecule, the salt is stabilized by an oxygen atom or the like contained in the ether link, and a low electric resistance value can be obtained. In this structure, the ether group is uniformly dispersed and fixed on the molecular level in a matrix polymer, so the variations in the resistance value associated with a dispersion error as seen. In a composition in which a conductive pigment is dispersed are not caused. Since the high-molecular form ionic-conductive material is a high-molecular form material, it hardly bleeds out. The thermoplastic resin containing the ether group includes a polyetheresteramide and a polyether/polyolefin block polymer. The thermoplastic resin containing the ether group is broadly divided into a hydrophilic grade and a hydrophobic grade by the ratio of the ether group, and their structures significantly differ. Therefore, it is possible to blend a plurality of grades in order to obtain an objective feature.

However, in the conductive function by the ionic conduction, a reaction involving hydroxide ion and hydrogen ion in a peripheral atmosphere has a part of the conductive path. Therefore, the impact of the water volume in the air on the conductive performance is extremely high, and the conduction property is obtained by the water absorption of the material itself. Accordingly, the high-molecular form ion-conductive material generally has a high water absorption property, and a large volume change (swelling property) by the water absorption. Therefore, when it is used as a material of the electric resistance-adjusting layer of the charging member of a close charging method, the environmental variation of the space of the photoconductor is increased, resulting in the decrease in the charging performance.

More particularly, since the resistance-adjusting layer expands in high-temperature and high-humidity environments, the space is decreased. Therefore, the charging member may have contact with the photoconductor in an extreme case. In this case, the discharge products and the remaining toners on the photoconductor adhere onto the charging member side with age, so that the conductive property in that portion is lowered. Therefore, an image error such as a black line is generated. On the other hand, since the space is increased in low-temperature and low-humidity environments, the discharge from the charging member to the photoconductor becomes uneven. For this reason, when an analogue half tone image is output, it appears as a white spot, resulting in an image error. In order to prevent the swelling property of the charging member, it is necessary to lower the water-absorption property by changing the blending prescription of the resistance-adjusting layer. In particular, the low water-absorption property of resin can be achieved by lowering the rate of ether group which contributes to the water-absorption property. However, in this case, the resistance is also increased, and the conductive property required for the charging member can not be obtained. In the previous research, the water-absorption property and the conductive property have a trade-off relationship, so it is difficult to achieve both of the decrease in the water-absorption property and the improvement in the conductive property.

Consequently, after studying the prescription of the resistance-adjusting layer, the present inventors have found out that when a fibrous polymer (B) which does not melt in a thermoplastic resin (A) containing an ether group and has an aromatic skeleton in the molecule is blended in (A), the water-absorption property is decreased without causing the resistance increase. Generally, when an insulating thermoplastic resin is blended in (A), the water-absorption property can be decreased, but the conductive property is decreased because of the resistance increase. On the other hand, when the fibrous polymer (B) which does not melt in (A) and has an aromatic skeleton in the molecule is blended, the resistance is not increased although it is also the insulating resin. Since this fibrous polymer (B) does not melt in (A) and has a stable aromatic skeleton in the molecule, a net structure is formed in (A) in an extremely stable state. A priority conductive path is established along the net structure, so that the conductive property is not decreased. Both of the decrease in the water-absorption property and the improvement in the conductive property can be thereby achieved. The fibrous polymer (B) which does not melt in (A) and has an aromatic skeleton in the molecule includes a wholly aromatic polyamide series fiber (aramid fiber), a wholly aromatic polyester fiber (polyarylate fiber) and a PBO (polyparaphenylenebenzobisoxazole). FIGS. 6-10 illustrate typical structures of the aramid fiber, polyarylate fiber and PBO fiber, respectively. These fibrous polymers are called a super fiber, and have excellent characteristics such as a high strength, a high elastic rate, and a high heat resistance property. Accordingly, both of the decrease in the water-absorption property and the improvement in the high conductive property can be achieved according to the blended prescription without lowering another feature. As for these fibrous polymers, the aramid fiber contains an amide group, the polyarylate fiber contains an ether group, and the PBO fiber contains the ether group. These groups are consistent with functional groups contained in a polyetherester amide and a polyether/polyolefin block polymer. Therefore, since these fibrous polymers have high affinity with (A), even dispersion can be easily obtained. As the aramid fiber, both of a para-form and a meta-form can be used. As the blending rate of (B), it is preferable to blend at the ratio of 0.01-30 weight % relative to the whole resin composition. When the blending quantity is lower than 0.01 weight %, the effects on the water-absorption property and the photoconductive property are not obtained. When the blending quantity is higher than 30 weight %, it becomes difficult to uniformly disperse in the resin composition. If the above-described fibrous polymers are used, it is possible to blend a plurality of fibrous polymers.

However, a conductive property for use in the charging member can not be obtained by using only a thermoplastic resin material having an ether group and fibrous polymer. For this reason, the conductive property can be improved by using an electrolyte salt together. The electrolyte salt includes a perchlorate, a fluorine-containing organic anion salt, and an organic phosphonium salt. These electrolyte salts have a high conductive property and a relatively low water absorption property. Therefore, both of the decrease in the water absorption property and the improvement in the conductive property can be achieved.

As the perchlorate, a general perchlorate salt can be used, but it is preferable to use a salt selected from an alkali metal salt or an alkaline earth metal salt, considering the conductive property. It is more preferable to use a lithium perchlorate or a sodium perchlorate because it has a high dissociation degree and the conductive property is improved because the amount of dissociation ion is increased.

As the fluorine-containing organic anion salt, it is preferable to use a salt including an anion having a fluoro group and a sulfonyl group. As for the salt having the above anion, the electric charge is not localized by a strong electronic suction effect by the fluoro group (—F) and the sulfonyl group (—SO2-), so the anion represents a high dissociation degree in the stable polymer composition, and a high ionic conductive property can be achieved. It is more preferable to use an alkali metal salt of bis(fluoroalkylsulfonyl) imide, an alkali metal salt of tris (fluoroalkylsulfonyl) methide, and an alkali metal salt of fluoroalkylsulfonate because the decrease in the resistance value can be easily achieved. More particularly, the fluorine-containing organic anion salt includes, for example, a bis (trifluoromethanesulfonyl) imide lithium (Li(CF3SO2)2N), a bis (trifluoromethanesulfonyl) imide potassium (K(CF3SO2)2N), a bis (trifluoromethanesulfonyl) imide sodium (Na(CF3SO2)2N), a tris (trifluoromethanesulfonyl) methide lithium (Li(CF3SO2)3C), a tris (trifluoroinethanesulfonyl) methide potassium (K(CF3SO2)3C), a tris (trifluoromethanesulfonyl) methide sodium (Na(CF3SO2)3C), a trifiluoromethanesulfonate lithium (Li(CF3SO3)), a trifluoromethanesulfonate potassium (K(CF3SO3)), and a trifluoromethanesulfonate sodium (Na(CF3SO3)). Especially, it is more preferable to use a lithium salt of a trifluoromethanesulfonate lithium, a bis(trifluoromethanesulfonyl) imide lithium and a tris (trifluoromethanesulfonyl) methide lithium because it has a small ion diameter of lithium ion which is a cation. Accordingly, the ion displacement is extremely high and the conductive property is improved.

The organic phosphonium salt includes a quaternary phosophonium salt such as an ethyltriphenylphosphonium-tetrafluoroborate or a tetraphenylphosphonium-bromide.

The electrolyte salt is added into the high-molecular form ionic-conductive material, and they are kneaded, so that the electrolyte salt can be blended at a predetermined rate. Plural types of electrolyte salts can be blended to be added. As the high-molecular form ionic-conductive material containing the electrolyte salt, for example, IRGASTAT P18 made by Chiba Specialty Chemicals can be used. As the high-molecular form ionic-conductive material containing the fluorine-containing organic anion salt, for example, SANCONOL series made by Sanko Chemical Co., Ltd. can be used. It is preferable for the blending quantity of salt to be blended at a rate of 0.01-20 weight % in the high-molecular form ionic-conductive material. If the blending quantity is lower than 0.01 weight %, a sufficient conductive property can not be obtained. If the blending quantity is higher than 20 weight %, it becomes difficult to uniformly disperse in a resin composition. It is preferable for the volume resistivity value of the resistance adjusting layer to be $10^6$ Ωcm$^{-10^9}$ Ωcm. If the volume resistivity value exceeds $10^9$ Ωcm, a sufficient charging performance and a sufficient transfer performance can not be obtained. If the volume resistivity value is lower than $10^6$ Ωcm, the leak is caused by the voltage concentration to the entire photoconductor.

The conductive member 101 for use in the present invention requires a machining process such as a cutting process or a grinding process, so as to achieve a highly accurate component.

It is difficult to conduct the machining process to a polyetherester amide and polyether/polyolefin block polymer because they are soft. Accordingly, it is possible to blend the resins with another thermoplastic resin (D) having a hardness higher than these resin. If the hardness is increased, the machining process performance is improved. The thermoplastic resin (D) having a high hardness is not especially limited. However, it is preferable to use a general purpose resin such as a polyethylene (PE), a polypropylene (PP), a polymethacrylmethacrylate (PMMA), or a polystyrene (PS) and the copolymer of the polystyrene (AS, ABS), or an engineering plastic such as a polycarbonate or a polyacetal because they are easily molded. The blending quantity can be set according to a target machining process within a range which does not disturb the conductive property of the electric resistance-adjusting layer 104. When it is combined with the fibrous polymer (B), the conductive property can be improved and also the water-absorption property can be decreased in the prescription which blends the thermoplastic resin having a hardness higher than (A).

When blending two kinds of resins, there may be a case that the compatibility between the two resins is low, so that a high conductive property may not be obtained. In this case, it is preferable to add a compatibilizer. The compatibilizer functions between the thermoplastic resins and is used for improving the compatibility. Such compatibilizer includes a graft copolymer (E) with affinity for both of the above-described (A), (D).

As the graft copolymer (E), a graft copolymer having a polycarbonate resin in a main-chain and an acrylonitrile-styrene-glycidylmethacrylate copolymer in a side chain is used. Since this polycarbonate resin in a main-chain includes a molecular structure having a chain of a polar group and a dioxy group, the attraction force between the molecules is very strong. Therefore, it is superior to a mechanical strength and a creep characteristic, and the impact force is especially remarkable compared to another plastic. In addition, the acrylonitrile-styrene-glycidylmethacrylate copolymer contained in the side chain is made of a glycidylmethacrylate component which is a reaction group of an acrylonitrile component and a styrene component. In the glycidylmethacrylate of the reaction group, the epoxy group reacts with the amide group and the ether group of (A) by heating when melting and kneading the component, and chemically and strongly is combined with (A). Moreover, the acrylonitrile component and the styrene component have preferable compatibility with (D). Therefore, since the graft copolymer of (E) functions as the compatibilizer between (A) and (D) having low affinity, and equalizes and densities the dispersion state of (A), (D), a high conductive property can be obtained. This graft copolymer has a low water absorption property, and has small amount of volume variations associated with the water-absorption. By the densified dispersion state, a surface area of a portion which has contact with the air is decreased on the surface of the resin (A), so that the low water-absorption property can be achieved. As a result, in the prescription which blends the fibrous polymer (B) and the graft copolymer (E), the conductive property can be further improved, and the water absorption property can be decreased. The compatibility of (A) and (D) is improved by setting the amount of graft copolymer to 1-15 weight % relative to the total of (A) and (D), so that an effective processing stability can be obtained.

A manufacturing method of a resin composition is not especially limited. The resin composition can be easily manufactured by melting and kneading a mixture of each material with a biaxial kneading machine or a kneader. The electric resistance adjusting layer 104 is easily formed on the conductive supporting body 106 by coating the semi-conductive resin component on the conductive supporting body 106 by means of extrusion molding or injection molding.

If the conductive member 101 is constituted by forming only the electric resistance-adjusting layer 104 on the conductive supporting body 106, the conductive property may be decreased because the toners or the toner additive agent are firmly fixed on the electric resistance-adjusting layer 104. Such a problem can be prevented by forming the surface layer 105 on the electric resistance-adjusting layer 104.

A resistance value of the surface layer 105 is set to be larger than a resistance value of the electric resistance-adjusting layer 104. The voltage concentration and abnormal discharge (leak) to a defect part of the photoconductive body can be thereby avoided. However, if the resistance value of the surface layer 105 is too high, the charging ability and the transfer ability are deteriorated. Accordingly, it is preferable for a volume resistivity of the surface layer 105 to be 1000 times or less of a volume resistivity of the electric resistance-adjusting layer 104.

As a material for forming the surface layer 105, a fluorine series resin, a silicone series resin, a polyamide resin, a polyester resin or the like is excellent in a non-adhesive performance, and is preferable in terms of preventing the fixation of the toners. The surface layer 105 is formed on the electric resistance-adjusting layer 104 by melting a material of the surface layer 105 into an organic solvent so as to manufacture a coating, and conducts a coating method such as spray paint, dipping, or roll coating. It is preferable for the layer thickness to be about 10-30 μm.

Both of a single pack and a double pack can be used for the material of the surface layer 105. However, by using a double pack coating using a curing agent together, an environmental resistance, a non-adhesive performance and a releasing performance can be improved. When the double pack coating is used, a method of linking and hardening a resin by heating a coating layer is general.

However, the electric resistance-adjusting layer 104 is a thermoplastic resin, so it can not be heated by a high temperature. As the double pack coating, it is effective to use a base resin having a hydroxyl group in the molecule and an isocyanate series resin which sets off a cross-linking reaction with a hydroxyl. By using an isocyanate series resin, the cross-linking and hardening reaction occur at a relatively low temperature of 100° C. or less. As a result of considering the non-adhesive performance of the toners, it is confirmed that the isocyanate series resin is a silicone series resin and has a high non-adhesive performance of toners. Especially, an acrylic silicone resin having an acrylic skeleton in the molecular is preferable.

An electric characteristic (resistance value) is important for the conductive member 101, so it is necessary for the surface layer 105 to have a conductive property. The conductive property can be formed by dispersing a conductive agent in a resin material. The conductive performance is not especially limited, and includes, for example, a conductive carbon such as a Ketjenblack EC or an acetylene black, a rubber carbon such as a SAF, ISAF, HAF, FEF, GPF, SRF, FT, or MT, a color carbon applied with an oxidization treatment and the like, a pyrolytic carbon, a metal such as an indium dope tin oxide (ITO), a tin oxide, a titanium oxide, a zinc oxide, a copper, a silver, or a germanium, and a conductive polymer such as a metallic oxide, a polyaniline, a polypyrrole, or a polyacetylene. In addition, a conduction application material includes an ionic-conductive substance, an inorganic ionic-conducive substance such as a sodium perchlorate, a lithium perchlorate, a potassium perchlorate or a lithium chloride, and an organic ionic-conductive substance such as a quaternary phosphonium salt, for example, an ethyltriphenylphosphonium•tetrafluoroborate, or a tetraphenylphosphonium bromide, a modified fatty acid dimethyl ammonium ethosulfate, a stearic ammonium acetate, or a lauryl ammonium acetate.

Embodiment 1

Figure 6:
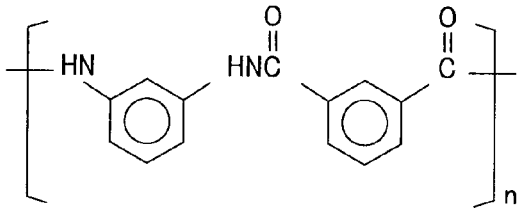
FIG. 6 is a view illustrating a typical structure of a fibrous polymer blended in Embodiment 1.

A resin composition (volume resistivity value: $2\times10^8$ Ωcm) in which the following prescription 1 was melted and kneaded at 220° C. was coated on a core shaft 106 (8 mm in outer diameter) which is a conductive supporting body made of a stainless-steel by means of injection molding, and an electric resistance-adjusting layer 104 was formed. The typical structure of the blended fibrous polymer is as illustrated in FIG. 6.

Prescription 1

A: IRGASTAT P18 (made by Chiba Specialty Chemicals, Inc.) 55 pts.wt.

(polyether ester amide, A contains sodium perchlorate)

B: Meta from aramid fiber (Conex 2.2 dtex, 1 mm made by Teijin Techno Products Limited) 5 pts.wt.

(Fibrous Polymer)

D: ABS resin (DENKA ABS, GR-3000 made by DENKI KAGAKU KOGYO KABUSHIKI KAISHA) 40 pts.wt.

(Thermoplastic Resin of High Hardness)

With respect to 100 pts.wt. of the mixture of A, B and D,

E: polycarbonate-glycidylmethacrylate-styrene-acrylonitrile copolymer (MODIPER C L440-G made by NOF CORPORATION) 4.5 pts.wt.

(Graft Copolymer)

Next, ring-shaped space holding members 103 made of a high-density polyethylene resin (NOVATEC HD HY540 made by Japan Polyethylene Corporation) were provided in both end portions of the electric resistance adjusting layer 104, respectively, and were bonded with the core shaft 106 and the electric resistance-adjusting layer 104.

Next, the outer diameter (the maximum diameter) of the space holding member 103 and the outer diameter of the electric resistance-adjusting layer 104 were simultaneously finished to 12.12 mm and 12.00 mm, respectively, by a cutting process.

Next, a surface layer 105 having a layer thickness of about 10 μm was formed on the surface of the electric resistance-adjusting layer 104 by a mixture (surface resistance: $2\times10^9$Ω) made of an acylic silicone resin (3000VH-P made by Kawakami Paint, Inc.), an isocyanate series resin, and a carbon black (35 pts.wt. relative to the total dissolved solid), and a conductive member 101 was obtained through a calcinations process.

However, dtex represents fineness of a fiber.

Embodiment 2

Figure 7:
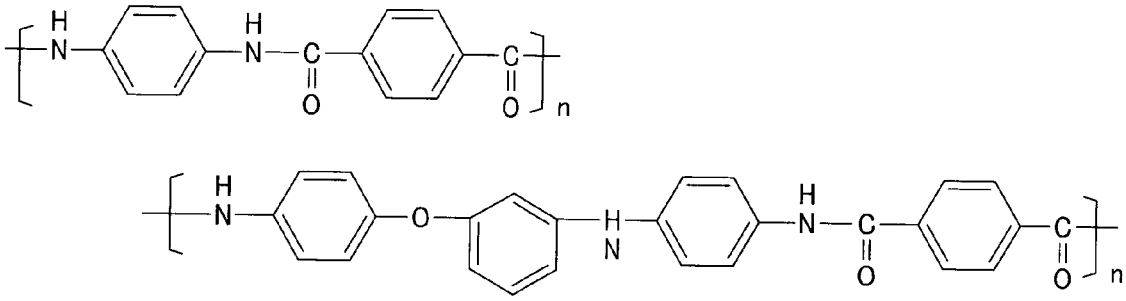
FIG. 7 is a view illustrating a typical structure of a fibrous polymer blended in Embodiment 2.

A resin composition (volume resistivity value: $2\times10^9$ Ωcm) in which the following prescription 2 was melted and kneaded at 220° C. was coated on a core shaft 106 (8 mm in outer diameter) made of a stainless-steel by means of injection molding, and an electric resistance layer 104 was formed. The typical structure of the blended fibrous polymer is as illustrated in FIG. 7.

Prescription 2

A: TPAE-10HP (made by FUJI KASEI KOGYO CO., LTD.) 50 pts.wt.

(Polyether Ester Amide)

B: Para form aramid fiber (Technora 1.7 dtexd, 1 mm made by Teijin Techno Products Limited) 10 pts.wt.

(Fibrous Polymer)

D: ABS resin (DENKA ABS GR-0500 made by DENKI KAGAKU KOGYO KABUSHIKI KAISHA) 40 pts.wt.

(Thermoplastic Resin of High Hardness)

With respect to 100 pts.wt. of the mixture of A, B, and D,

E: polycarbonate-glycidylmethacrylate-styrene-acrylonitrile copolymer (MODIPER C L440-G made by NOF CORPORATION) 4.5 pts.wt. (graft copolymer)

C: trifluoromethanesulfonate lithium (LiTFS made by Morita Chemical Industries Co., Ltd.) 3 pts.wt. (fluorine-containing organic anion salt)

A conductive member 101 was obtained through the post-processes which are the same as the processes in Embodiment 1.

Embodiment 3

Figure 8:
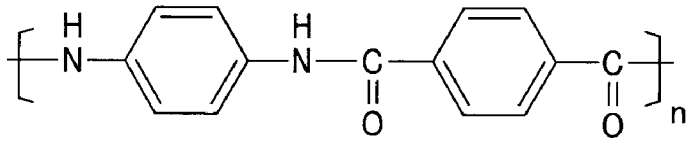
FIG. 8 is a view illustrating a typical structure of a fibrous polymer blended in Embodiment 3.

A resin composition (volume resistivity value: $3\times10^8$ Ωcm) in which the following prescription 3 was melted and kneaded at 230° C. was coated on a core shaft 106 (8 mm in outer diameter) made of a stainless-steel by means of injection molding, and an electric resistance-adjusting layer 104 was formed. The typical structure of the blended fibrous polymer is as illustrated in FIG. 8.

Prescription 3

A: Sankonol TBX-65 (made by Sanko Chemical Ind, Co., Ltd.) 60 pts.wt.

(Polyether Ester Amide, a Contains Trifluoromethanesulfonate Lithium).

B: Para form aramid fiber (Twaron 1.7 dtex, 0.25 mm made by Teijin Techno Products) 10 pts.wt. (fibrous polymer)

D: Polycarbonate resin (Iupilon H-4000 made by Mitsubishi Engineering-Plastics Corporation) 30 pts.wt. (thermoplastic resin of high hardness)

With respect to 100 pts.wt. of the mixture of A, B, and D,

E: Polycarbonate-glycidylmethacrylate-styrene-acrylonitrile copolymer (MODIPER C L440-G made by NOF CORPORATION) 4.5 pts.wt. (graft copolymer)

C: lithium perchlorate (made by Mitsuwa Chemicals Co., Ltd.) 3 pts.wt. (perchlorate)

A conductive member 101 was obtained through the post-processes which are the same as the processes in Embodiment 1.

Embodiment 4

Figure 9:
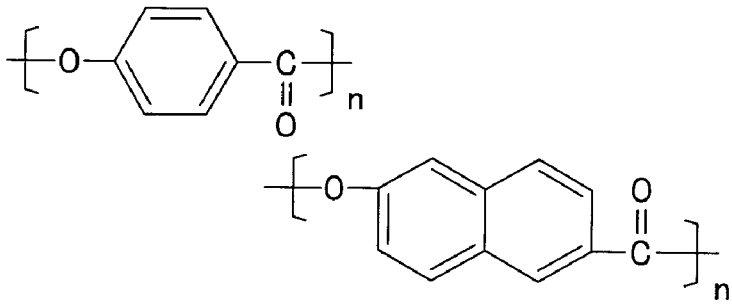
FIG. 9 is a view illustrating a typical structure of a fibrous polymer blended in Embodiment 4.

A resin composition (volume resistivity value: $4\times10^8$ Ωcm) in which the following prescription 4 was melted and kneaded at 220° C. was coated on a core shaft 106 (8 mm in outer diameter) made of a stainless-steel by means of injection molding, and an electric resistance-adjusting layer 104 was formed. The typical structure of the blended fibrous polymer is as illustrated in FIG. 9.

Prescription 4

A: Sankonol TBX-310 (made by Sanko Chemical Ind, Co., Ltd.) 45 pts.wt.

(Polyolefin Block Polymer, A Contains Trifluoromethanesulfonate Lithium)

B: Polyarylate fiber (Vectran 2.8 dtex, 1 mm made by KURARAY CO., LTD.) 5 pts.wt. (fibrous polymer)

D: ABS resin (DENKA ABS GR-0500 made by DENKI KAGAKU KOGYO) 50 pts.wt. (thermoplastic resin of high hardness)

With respect to 100 pts.wt of the mixture of A, B and D,

E: Polycarbonate-glycidylmethacrylate-styrene-acrylonitrile copolymer (MODIPER C L440-C made by NOF CORPORATION) 9 pts.wt. (graft copolymer)

C: Organic phosphonium salt (Hishicolin ETPP-FB, Nippon Chemical Industrial Co., Ltd.) 1 pts.wt. (organic phosphonium salt)

A conductive member 101 was obtained through the post-processes which are same as the processes in Embodiment 1.

Embodiment 5

Figure 10:
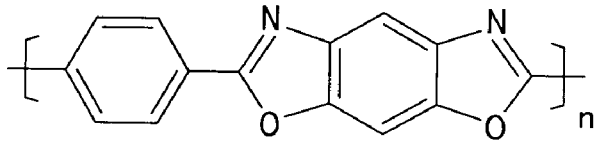
FIG. 10 is a view illustrating a typical structure of a fibrous polymer blended in Embodiment 5.

A resin composition (volume resistivity value: $3\times10^8$ Ωcm) in which the following prescription 5 was melted and kneaded at 220° C. was coated on a core shaft 106 (8 mm in outer diameter) made of a stainless-steel by means of injection molding, and an electric resistance-adjusting layer 104 was formed. The typical structure of the blended fibrous polymer is as illustrated in FIG. 10.

Prescription 5

A: Pebax MV1041 (made by ARKEMA) 50 pts.wt.

(Polyetherester Amide)

B: PBO fiber (Zylon AS 1.7 dtex, 1 mm made by Toyobo Co., Ltd.) 10 pts.wt. (fibrous polymer)

D: HI-PS resin (H450 made by Toyo Styrene Co., Ltd.) 40 pts.wt. (thermoplastic resin of high hardness)

With respect to 100 pts.wt. of the mixture of A, B and D,

E: polycarbonate-glycidylmethacrylate-styrene-acrylonitrile copolymer (MODIPER C L440-G made by NOF CORPORATION) 4.5 pts.wt. (graft copolymer)

C: lithium perchlorate (made by Mitsuwa Chemicals Co., Ltd.) 3 pts.wt. (perchlorate)

bis(pentafluoroethanesulfonyl) imide lithium (LiBETI made by Kishida Chemical Co., Ltd.) 1 pts.wt. (fluorine-containing organic anion salt)

A conductive member was obtained through the post-processes which are the same as the processes in Embodiment 1.

Comparative Example 1

Figure 11:
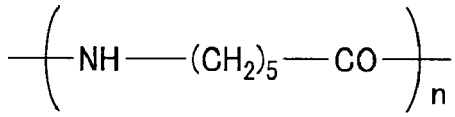
FIG. 11 is a view illustrating a typical structure of a fibrous polymer blended in Comparative Example 1.

A core shaft (8 mm in outer diameter) made of a stainless-steel was coated by means of injection molding without melting and kneading the following prescription 6, and an electric resistance adjusting layer was formed. The typical structure of the blended fibrous polymer is as illustrated in FIG. 11.

Prescription 6

A: IRGASTAT P18 (made by Chiba Speciality Chemicals) 60 pts.wt. (polyether ester amide, A contains perchrolate)

B: Polyamide fiber (Toray Nylon 6 1.7 dtex, 1 mm made by Toray Industries, Inc.) 10 pts.wt. (fibrous polymer)

D: ABS resin (DENKA ABS GR-0500 made by DENKI KAGAKU KOGYO) 30 pts.wt. (thermoplastic resin of high hardness)

A conductive member was obtained through the post-processes which are the same as the processes in Embodiment 1.

Comparative Example 2

Figure 12:
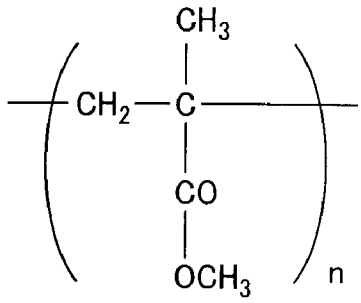
FIG. 12 is a view illustrating a typical structure of a fibrous polymer blended in Comparative Example 2.

A core shaft (8 mm in outer diameter) made of a stainless-steel was coated by means of injection molding without melting and kneading the following prescription 7, and an electric resistance-adjusting layer was formed. The typical structure of the blended fibrous polymer is as illustrated in FIG. 12.

Prescription 7

A: Pebax 5533 (made by ARKEMA) 40 pts.wt. (polyether ester amide)

B: Polynylon fiber (Toray Nylon 66 1.7 dtex 1 mm made by Toray Industries Inc.) 10 pts.wt. (fibrous polymer)

D: Polycarbonate resin (Panlite L-1225L made by Teijin Chemicals Ltd.) 50 pts.wt. (thermoplastic resin of high hardness)

Relative to 100 pts.wt. of the mixture of A, B and D,

C: Organic phosphonium salt (Hishicolin ETPP-I made by Nippon Chemical Industrial Co., Ltd.) 3 pts.wt. (organic phosphonium salt)

A conductive member was obtained through the post-processes which are the same as the processes in Embodiment 1.

Comparative Example 3

Figure 13:
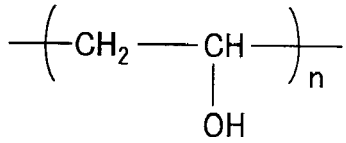
FIG. 13 is a view illustrating a typical structure of a fibrous polymer blended in Comparative Example 3.

A core shaft (8 mm in outer diameter) made of a stainless-steel was coated by means of injection molding without melting and kneading the following prescription 8, and an electric resistance-adjusting layer was formed. The typical structure of the blended fibrous polymer is as illustrated in FIG. 13.

Prescription 8

A: Polyether ester amide (Pelestat 300 made by Sanyo Chemical Industries, Ltd) 50 pts.wt. (polyether ester amide)

B: Polyvinyl alcohol fiber (Vinylon SMR 1.1 dtex 1 mm made by Unitika Ltd.) 10 pts.wt. (fibrous polymer)

D: Polypropylene resin (Novatec-PP MA3 made by Japan Polypropylene Corporation.) 40 pts.wt. (thermoplastic resin of high hardness)

Relative to 100 pts.wt. of the mixture of A) B and D,

C: Lithium perchlorate (made by Mitsuwa Chemicals Co., Ltd.) 2 pts.wt. (perchlorate) trifluoromethanesulfonate lithium (LiTFS made by Morita Chemical Industries Co., Ltd.) 3 pts.wt. (fluorine-containing organic anion salt)

A conductive member was obtained through the post-processes which are the same as the processes in Embodiment 1.

Comparative Example 4

Figure 14:
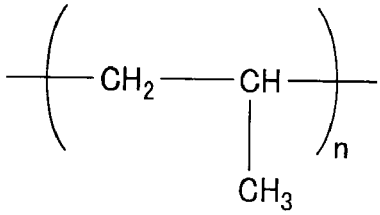
FIG. 14 is a view illustrating a typical structure of a fibrous polymer blended in Comparative Example 4.

A core shaft (8 mm in outer diameter) made of a stainless-steel was coated by means of injection molding without melting and kneading the following prescription 9, and an electric resistance-adjusting layer was formed. The typical structure of the blended fibrous polymer is as illustrated in FIG. 14.

Prescription 9

A: polyether ester amide (Pelestat NC6321 made by Sanyo Chemical Industries, Ltd) 70 pts.wt. (polyether ester amide)

B: Polypropylene fiber (Pylen 1.7 dtex, 1 mm made by Mitsubishi Rayon Co., Ltd.) 10 pts.wt. (fibrous polymer)

D: Polyethylene resin (Novatech HD HJ360 made by Japan Polyethylene Corporation) 20 pts.wt. (thermoplastic resin of high hardness)

Relative to 100 pts.wt. of the mixture of A, B and D,

C: trifluoromethanesulfonate lithium (LiTFS made by Morita Chemical Industries Co., Ltd.) 3 pts.wt. (fluorine-containing organic anion salt)

A conductive member was obtained through the post-processes which are the same as the processes in Embodiment 1.

Table 1 illustrates the structures of Embodiments and Comparative Examples.

TABLE 1

| | | polyetheresteramide, polyolefin block polymer (A) | fibrous polymer (B) | resin (D) having a hardness higher than that of (A) | electrolyte salt (C) | graft copolymer (E) |
|---|---|---|---|---|---|---|
| Embodiment 1 | Material | IRGASTAT P18 (contain Na) | meta form aramid fiber Conex | ABS GR-3000 | contained in A | Modiper GL440G |
| | Blending Quantity | 55 pts. wt. | 5 pts. wt. | 40 pts. wt. | | 4.5 pts. wt. relative to 100 pts. wt. of A + B + C |
| Embodiment 2 | Material | TPAE-10HP | para form aramid fiber Technora | ABS GR-0500 | LiTFS | same as above |
| | Blending Quantity | 50 | 10 | 40 | 3 pts. wt. | same as above |
| Embodiment 3 | Material | TBX-65 (contain LiTFS) | para form aramid fiber Twaron | PC H-4000 | perchlorate Li | same as above |
| | Blending Quantity | 60 | 10 | 30 | 3 pts. wt. | same as above |
| Embodiment 4 | Material | TBX-310 (contain LiTFS) | polyarylate fiber Vectran | ABS GR-0500 | ETPP-FB | same as above |
| | Blending Quantity | 45 | 5 | 50 | 1 pts. wt. | 9 pts. wt. |
| Embodiment 5 | Material | MV1041 | PBO fiber Zylon | HI-PS H450 | perchlorate Li LiBETI | same as above |
| | Blending Quantity | 50 | 10 | 40 | 3 pts. wt. 1 pts. wt. | same as above |
| Comparative Example 1 | Material | IRGASTAT P18 (contain Na) | Polyamide fiber Nylon 6 | ABS GR-0500 | Contained in A | none |
| | Blending Quantity | 60 | 10 | 30 | — | — |
| Comparative Example 2 | Material | 5533 | Polyamide fiber Nylon 66 | PC L-1225L | ETPP-1 | none |
| | Blending Quantity | 40 | 10 | 50 | 3 pts. wt. | — |

TABLE 1-continued

| | | polyethere-steramide, polyolefin block polymer (A) | fibrous polymer (B) | resin (D) having a hardness higher than that of (A) | electrolyte salt (C) | graft copolymer (E) |
|---|---|---|---|---|---|---|
| Comparative Example 3 | Material | 300 | PVA fiber Vinylon | PP MA3 | perchlorate Li LiTFS | none |
| | Blending Quantity | 50 | 10 | 40 | 2 pts. wt. 3 pts. wt. | — |
| Comparative Example 4 | Material | NC6321 | Polypropylene fiber Pylen | PE HJ360 | LiTFS | none |
| | Blending Quantity | 70 | 10 | 20 | 3 pts. wt. | — |

[Test 1]

Circular plate test pieces (TP) each of 1 mm thick and Φ43 mm were molded by using the molded resin materials of the electric resistance-adjusting layers 104 of Embodiments and Comparative Examples. The volume resistance of each TP was measured at an application voltage of 100V in a standard environment (23° C. 50% RH) by using a resistance measuring jig which measures the TP while sandwiching the TP from the up and down direction. Moreover, after adjusting each TP for one day in standard environment (23° C. 50% RH), the water-absorption rate of the TP was measured from the change in the weight after leaving for about one day in a high-temperature and high-humidity environment (30° C. 90% RH).

Figure 15:
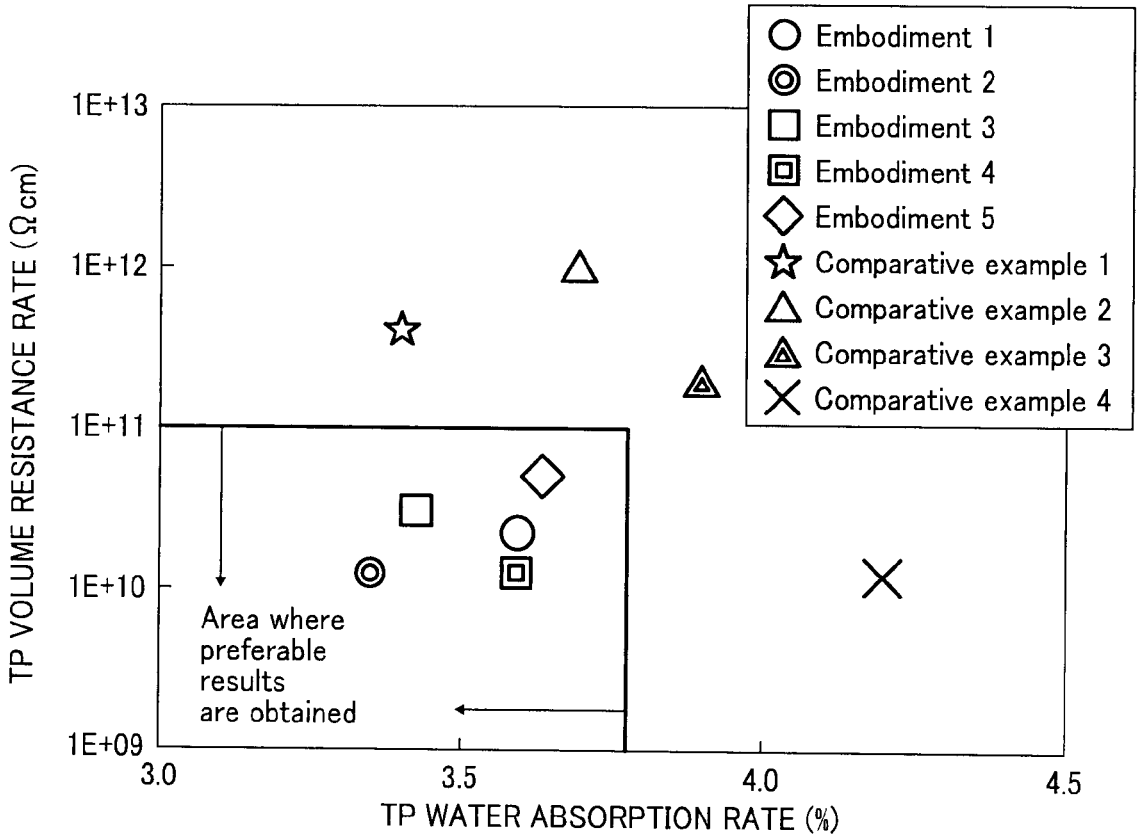
FIG. 15 is a view illustrating an evaluation result of Test 1.

The results are illustrated in FIG. 15 and Table 2. According to the results of Embodiments, low water-absorption rates and low volume resistance values which are good results were obtained in Embodiment. However, according to the results of Comparative Examples, satisfactory water-absorption rates and satisfactory volume resistance values were not obtained in Comparative Examples.

TABLE 2

| | TP volume resistance rate 100 V(Ωcm) (23° C. 50% environment) | TP water absorption rate (%) (23° C. 50% environment ⇒ 30° C. 90% environment one day) | evaluation |
|---|---|---|---|
| Embodiment 1 | 2.2E+10 | 3.60 | OK |
| Embodiment 2 | 1.2E+10 | 3.35 | OK |
| Embodiment 3 | 3.0E+10 | 3.43 | OK |
| Embodiment 4 | 1.2E+10 | 3.60 | OK |
| Embodiment 5 | 5.0E+10 | 3.64 | OK |
| Comparative example 1 | 4.0E+11 | 3.40 | NG |
| Comparative example 2 | 1.0E+12 | 3.70 | NG |
| Comparative example 3 | 2.0E+11 | 3.90 | NG |
| Comparative example 4 | 1.2E+10 | 4.20 | NG |

[Test 2]

Figure 2:
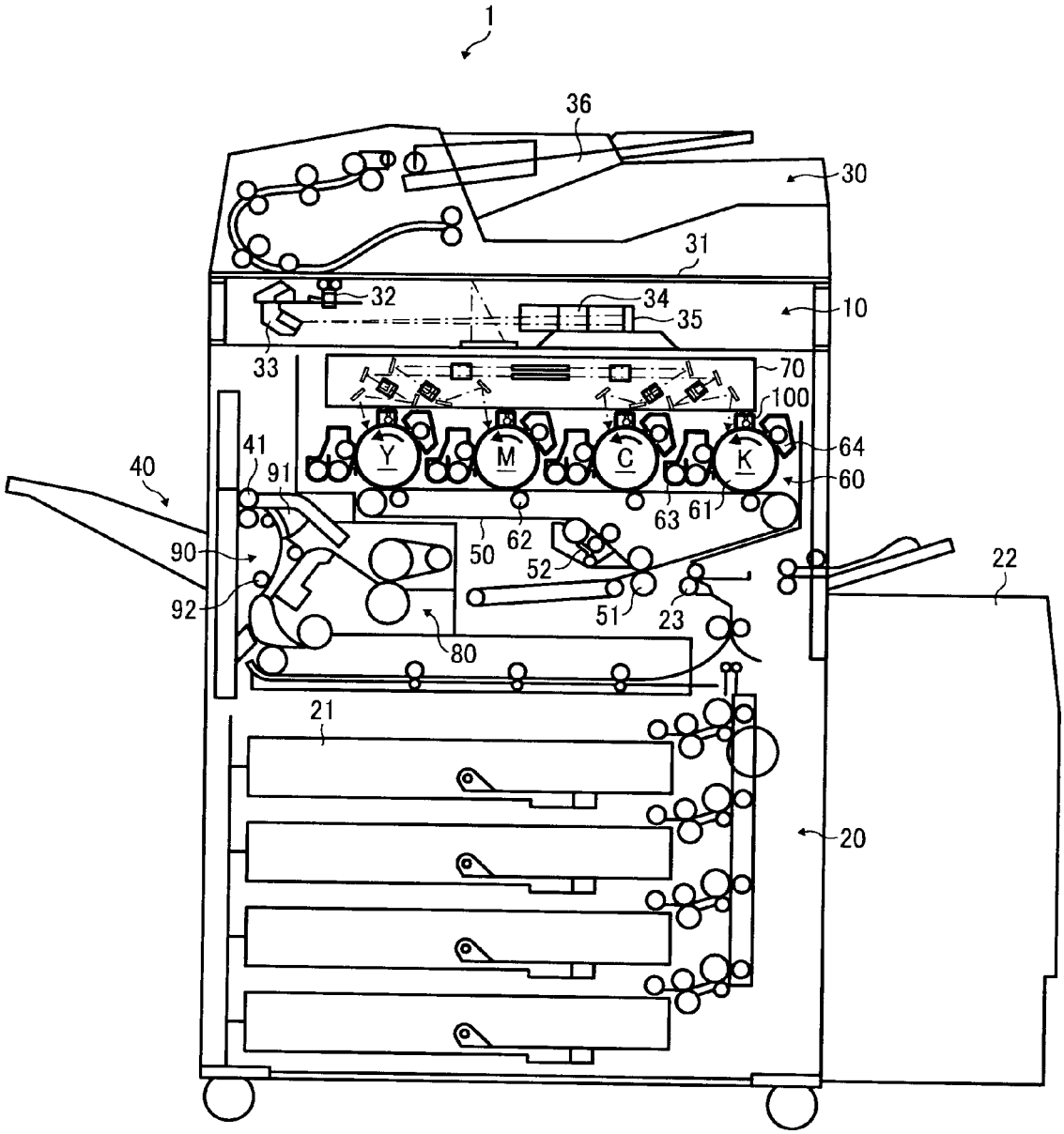
FIG. 2 is a schematic view illustrating a structure of an image forming device using a process cartridge and a charging unit when a conductive member according to an embodiment of the present invention is used as a charging member.

After leaving the conductive member of each of Embodiments and Comparative Examples for one day in a high-temperature and high-humidity environment (30° C. 90% RH), 50000 sheets of paper were continuously copied in a high-temperature and high-humidity environment (30° C. 90% RH) by using the image forming device illustrated in FIG. 2. Then, the existence or nonexistence of an image error by the adhesion of toners, discharge products or the like to the surface of the charging roller was evaluated. In this case, the voltage applied to the charging roller was DC=−700V and AC Vpp=2.2 kV (frequency=2.2 kHz). By the continuously copying with the cleaning member 64*c* in FIG. 4 being removed, the acceleration was evaluated.

The test results are illustrated in Table 3. According to the results, even if 50000 sheets were copied, the roller of each Embodiment did not cause an image error such as black stripes, and a preferable image was obtained. However, the roller of each Comparative Example causes an image error such as black stripes by the copying of 50000 sheets or less. The rollers of Comparative Examples 1, 2 had an extremely high resistance, so that an image could not be output.

TABLE 3

| | The number of durable sheets till an image error such as a black line is generated (30° C. 90% environment) | Evaluation |
|---|---|---|
| Embodiment 1 | An error is not generated at copy of 50000 sheets | OK |
| Embodiment 2 | An error is not generated at copy of 50000 sheets | OK |

TABLE 3-continued

| | The number of durable sheets till an image error such as a black line is generated (30° C. 90% environment) | Evaluation |
|---|---|---|
| Embodiment 3 | An error is not generated at copy of 50000 sheets | OK |
| Embodiment 4 | An error is not generated at copy of 50000 sheets | OK |
| Embodiment 5 | An error is not generated at copy of 50000 sheets | OK |

TABLE 3-continued

| | The number of durable sheets till an image error such as a black line is generated (30° C. 90% environment) | Evaluation |
|---|---|---|
| Comparative example 1 | An image can not be output | NG |
| Comparative example 2 | An image can not be output | NG |
| Comparative example 3 | An error is generated at copy of 10000 sheets. | NG |
| Comparative example 4 | An error is generated at copy of 20000 sheets. | NG |

As illustrated in the evaluation results in FIG. 15, the electric resistance adjusting layer 104 of each Embodiment can reduce its water-absorption rate without losing the conductive property. More particularly, the conductive member 101 of each Embodiment can reduce its water-absorption property without losing the conductive property.

Accordingly, the environmental change in the space G between the conductive member 101 and the image carrier 61 can be reduced, and an image error caused by the environmental change of the space G can be prevented.

According to the embodiment of the present invention, the following effects can be obtained.

Since the conductive member includes the conductive supporting body, the electric resistance-adjusting layer formed in the conductive supporting body, and the space holding member, which is formed on each end of the electric resistance adjusting layer and has a material different from a material of the electric resistance adjusting layer, the space holding member constantly maintaining a space between an image carrier and the electric resistance adjusting layer, and the electric resistance-adjusting layer including the resin composition having the thermoplastic resin (A) containing at least an ether group, the fibrous polymer (B), which do not melt in (A) and has the aromatic skeleton in the molecular, and the electrolyte salt (C), the water-absorption property of the electric resistance-adjusting layer can be reduced without increasing the resistance of the resistance-adjusting layer. Therefore, the environmental change in the space between the conductive member and the image carrier can be reduced, so the generation of the image error by the environmental change in the space can be prevented.

In addition, by blending, as the fibrous polymer (B), at least one or more type of fibrous polymer selected from a wholly aromatic polyamide fiber (aramid fiber), a wholly aromatic polyester fiber (polyarylate fiber), and a PBO (polyparaphenylenebenzobisoxazole), the fibrous polymer can be dispersed in the thermoplastic resin (A) containing an ether group in a extremely stable state. Therefore, the decrease in the water-absorption property and the improvement in the conductive property can be achieved without losing another feature.

Moreover, when blending the thermoplastic resin (D) having a hardness higher than that of the thermoplastic resin (A) containing an ether group, (D) has a water-absorption rate lower than that of (A), so that a low water-absorption rate can be obtained without decreasing the conductive property. Accordingly, the resistance-adjusting layer, which achieves both of the improvement in the conductive property and the decrease in the water-absorption property, can be obtained.

Furthermore, when blending the graft copolymer (E) with an affinity for (A) and (D), (E) has a water-absorption rate lower than that of (A), so that a low water-absorption rate can be obtained without decreasing the conductive property. Accordingly, the resistance-adjusting layer, which achieves both of the improvement in the conductive property and the decrease in the water-absorption property, can be obtained.

In addition, by using, as the thermoplastic resin (A) containing an ether group, the compound having a functional group which coincides with a functional group of the fibrous polymer (B) such as a polyether ester amide and a polyether/polyolefin block polymer, a high affinity can be obtained between (A) and (B). Therefore, a further improved characteristic can be obtained by the even dispersion.

By blending, as the graft copolymer (E), the graft copolymer having a polycarbonate resin in a main chain and an acrylonitrile-styrene-glycidylmethacrylate copolymer in a side chain, this graft copolymer functions as a compatibilizer, so that the decrease in the characteristic associated with the deterioration of the compatibility of (A) and (D) is not caused. This graft copolymer also has a low water-absorption rate, so the water-absorption property can be decreased.

Moreover, since the resin composition is obtained by melting and kneading, a further densified dispersion state can be obtained by the heating in the melting and kneading by the effect of the graft copolymer. Therefore, the conductive property is improved. Furthermore, by the densified dispersion state, the surface area of (A) which has contact with air in the resin is decreased, so that the water-absorption property can be reduced.

By blending, as the electrolyte salt (C), at least one or more type of salt selected from a perchlorate, a fluorine-containing organic anion salt, and an organic phosphonium salt, the improved conductive property and the decreased water-absorption property can be obtained.

Moreover, when the perchlorate is a salt having a high dissociation degree such as a salt selected from a lithium perchlorate and a sodium perchlorate, the amount of dissociation ion which contributes to the conductive property is increased. Therefore, the improved conductive property and the decreased water-absorption property can be obtained Furthermore, by using, as the fluorine-containing organic anion salt, a lithium salt having a small ion radius of a cation, for example, a salt selected from a trifluoromethanesulfonate lithium, a bis(trifluoromethane)sulfonyl imide acid lithium, and a tris(trifluoromethane)sulfonyl methide acid lithium, the ion mobility and the conductive property are improved.

By setting a blending ratio of the fibrous polymer (B) to 0.01-30 pwts.wt. relative to the entire resin composition, the effects on the conductive property and the water-absorption property are obtained, and also an even dispersion property can be obtained.

In addition, by using the conductive member as the charging member for a close charging method, a high image quality can be obtained in any environment. Moreover, in a process cartridge having the above-described conductive member 10, a high image quality can be obtained. By using such a process cartridge, the image forming device which can obtain a high image quality for a long period of time can be obtained.

As described above, the conductive member, the process cartridge using the conductive member, and the image forming device using the process cartridge are described in the above embodiment. However, the specific structures are not limited thereto. It should be appreciated that variations may be made in the embodiment described by person skilled in the art without departing from the scope of the present invention as defined by the following claims.

What is claimed is:

1. A conductive member, comprising:

a conductive supporting body;

an electric resistance-adjusting layer formed in the conductive supporting body; and a space holding member which is formed on each end of the electric resistance adjusting layer and is made of a material different from a material of the electric resistance-adjusting layer, the space holding member constantly maintaining a space between an image carrier and the electric resistance-adjusting layer, and the electric resistance-adjusting layer including a resin composition having a thermoplastic resin (A) containing at least an ether group, a fibrous polymer (B) which does not melt in (A) and includes a molecule having an aromatic skeleton in a molecule, and an electrolyte salt (C).

2. The conductive member according to claim 1, wherein the fibrous polymer (B) is at least one or more type of fibrous polymer selected from a wholly aromatic polyamide fiber (aramid fiber), a wholly aromatic polyester fiber (polyarylate fiber), and a PBO (polyparaphenylenebenzobisoxazole).

3. The conductive member according to claim 1, wherein the electric resistance-adjusting layer includes a resin composition in which a thermoplastic resin (D) having a hardness higher than (A) is added to the resin composition.

4. The conductive member according to claim 3, wherein the electric resistance-adjusting layer includes a resin composition in which a graft copolymer (E) with an affinity for (A) and (D) is added to the resin composition.

5. The conductive member according to claim 4, wherein the graft copolymer (E) is a graft copolymer having a polycarbonate resin in a main chain and an acrylonitrile-styrene-glycidylmethacrylate copolymer in a side chain.

6. The conductive member according to claim 1, wherein the thermoplastic resin (A) containing the ether group is a compound containing at least a polyether ester amide and a polyether/polyolefin block polymer.

7. The conductive member according to claim 1, wherein the resin composition is obtained by melting and kneading.

8. The conductive member according to claim 1, wherein the electrolyte salt (C) is at least one or more type of salt selected from a perchlorate, a fluorine-containing organic anion salt, and an organic phosphonium salt.

9. The conductive member according to claim 8, wherein the perchlorate is a salt selected from a lithium perchlorate and a sodium perchlorate.

10. The conductive member according to claim 8, wherein the fluorine-containing organic anion salt is a salt selected from a trifluoromethanesulfonate lithium, a bis(trifluoromethane) sulfonyl imide acid lithium, and a tris (trifluoromethane) sulfonyl methide acid lithium.

11. The conductive member according to claim 1, wherein a blending ratio of the fibrous polymer (B) is 0.01-30 pwts.wt. relative to the entire resin composition.

12. The conductive member according to claim 1, wherein the conductive member charges the image carrier.

13. A process cartridge comprising the conductive member set forth in claim 12.

14. An image forming device comprising the process cartridge set forth in claim 13.

15. The conductive member according to claim 1, wherein said fibrous polymer (B) which does not melt in (A) and includes the molecule having the aromatic skeleton decreases a water absorption property of the thermoplastic resin and does not decrease a conductive property of the thermoplastic resin.

* * * * *